United States Patent [19]

Sung

[11] 4,187,622

[45] Feb. 12, 1980

[54] INNER SOLE FOR A SHOE

[76] Inventor: Fong G. Sung, No. 116, Tam Kung Rd., 1st Floor, Kowloon, Hong Kong

[21] Appl. No.: 903,570

[22] Filed: May 8, 1978

[30] Foreign Application Priority Data

Jan. 12, 1978 [GB] United Kingdom ..... 1274/78

[51] Int. Cl.[2] ..... A43B 13/38; A43B 7/06

[52] U.S. Cl. ..... 36/44; 36/3 B

[58] Field of Search ..... 36/44, 43, 3 R, 3 B; 128/594, 595, 588

[56] References Cited

U.S. PATENT DOCUMENTS

| | | | |
|---|---|---|---|
| 859,113 | 7/1907 | Roosa | 36/44 |
| 2,425,388 | 8/1947 | Oestricher | 36/44 X |
| 2,671,277 | 3/1954 | Montgomery | 36/44 X |
| 2,713,214 | 7/1955 | Gulaskie | 36/44 |
| 2,911,973 | 11/1959 | Chieffo | 36/43 X |
| 3,555,709 | 1/1971 | Raffaelli, Sr. | 36/44 |

FOREIGN PATENT DOCUMENTS

| | | | |
|---|---|---|---|
| 505416 | 8/1954 | Canada | 36/44 |
| 2310100 | 3/1976 | France | 36/3 B |

*Primary Examiner*—James Kee Chi

*Attorney, Agent, or Firm*—Basile and Weintraub

[57] ABSTRACT

An inner sole for a shoe consists of two flat layers of mesh joined together around their outer edges to define an internal cavity. A powder such as talcum powder or a medicinal powder can be put in the cavity before the two layers are completely joined. The sole is put in the bottom of a shoe, and the powder is able to work through the mesh to affect a foot in the shoe.

1 Claim, 2 Drawing Figures

INNER SOLE FOR A SHOE

SUMMARY OF THE INVENTION

The invention relates to an inner sole for a shoe, which can be filled with powder such as medicinal powder to kill bacteria on the feet, or talcum powder to keep the feet dry.

According to the invention, there is provided an inner sole for a shoe, the sole comprising two layers of a flexible mesh sealed together around the edges to define an internal cavity which contains powder.

The flexible mesh may be a nylon fabric mesh, the edges of which are heat-sealed.

Further features and advantages of the present invention will become apparent from the following description to be read in conjunction with the accompanying drawing.

DETAILED DESCRIPTION OF THE EMBODIMENT

Figure 1:
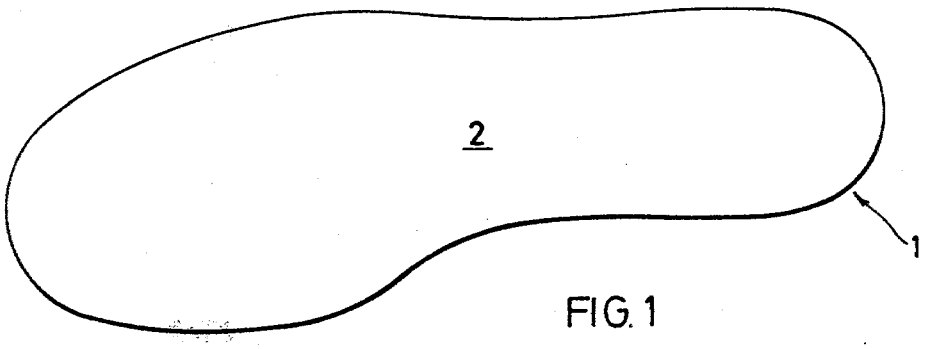
FIG. 1 is a plan view of a sole according to the invention.
Figure 2:
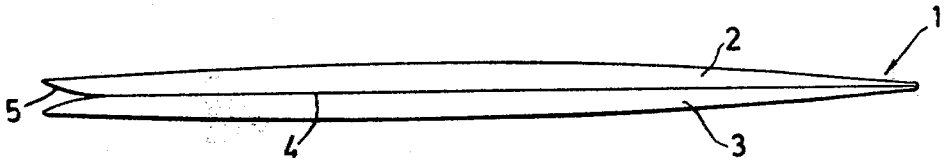
FIG. 2 is a side view of the sole of FIG. 1.

The sole 1 is shaped to fit inside a shoe, and soles of different sizes will be produced to fit the various sizes of shoe. It is not necessary to produce left and right foot soles, because both top and bottom are identical, and so any sole will fit either shoe if it is just turned over.

The sole consists of top and bottom layers 2, 3 of nylon fabric mesh. The edges of the layers are sealed together around the perimeter of the sole on a line 4 to form an internal cavity. Initially, an opening 5, about two inches long, is left at the toe of the sole through which the powder can be inserted. The manufacturing process is then completed by sealing the opening.

The powder used can be a medicinal powder for killing bacteria on the feet or for healing wounds or skin diseases, or just talcum powder for keeping the feet dry in summer.

For a sole for a size 9 shoe, about 0.6 ounces of powder is needed.

In use, the sole is placed inside a shoe. When pressure is exerted by the foot, the powder will seep through the mesh to fill the inside of the shoe.

I claim:

1. An inner sole for a shoe comprising:

a first layer fabricated from a nylon fabric mesh material;

a second layer fabricated from an identical nylon fabric mesh material, said first layer being identical in size, shape and contour to said second layer, said first and second layers being disposed in opposing relationship such that their contours mate and edges abut, said first and second layers being sealed together at their abutting edges such that the opposing surfaces of said first and second layers define a cavity thereinbetween;

a medicinal powder disposed in said cavity, said inner sole being reversible and thus positionable in either a left or right foot shoe, said nylon fabric mesh being sized that said powder will seep through said mesh into the interior of said shoe when pressure of a foot is exerted on said inner sole.

* * * * *